US011772234B2

(12) United States Patent
Tolles et al.

(10) Patent No.: US 11,772,234 B2
(45) Date of Patent: Oct. 3, 2023

(54) SMALL BATCH POLISHING FLUID DELIVERY FOR CMP

(71) Applicant: Applied Materials, Inc., Santa Clara, CA (US)

(72) Inventors: Robert D. Tolles, San Jose, CA (US); Kirk Liebscher, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 243 days.

(21) Appl. No.: 16/803,223

(22) Filed: Feb. 27, 2020

(65) Prior Publication Data

US 2021/0122008 A1 Apr. 29, 2021

Related U.S. Application Data

(60) Provisional application No. 62/926,097, filed on Oct. 25, 2019.

(51) Int. Cl.
*B24B 57/02* (2006.01)
*B24B 37/20* (2012.01)

(52) U.S. Cl.
CPC ..... *B24B 57/02* (2013.01); *B24B 37/20* (2013.01)

(58) Field of Classification Search
CPC ..... B24B 57/02; B24B 37/20; B24B 37/04
USPC ..... 451/41, 287, 446, 60
See application file for complete search history.

(56) References Cited

U.S. PATENT DOCUMENTS 1,716,504 A 6/1929 Pierce
3,161,144 A 12/1964 Hugentobler
3,684,250 A 8/1972 Roeser
3,786,966 A 1/1974 Behunin et al.
3,877,682 A 4/1975 Moss
(Continued)

FOREIGN PATENT DOCUMENTS

WO 2008139417 A2 11/2008
WO 2013091992 A1 6/2013

OTHER PUBLICATIONS

Written opinion of the international searching authority and International Search Report for PCT/US2020/054626 dated Feb. 17, 2021.

*Primary Examiner* — Joel D Crandall
*Assistant Examiner* — Shantese L McDonald
(74) *Attorney, Agent, or Firm* — Patterson + Sheridan, LLP

(57) ABSTRACT

In one embodiment, a fluid delivery apparatus includes a vessel body having a first chamber and a second chamber disposed therein, a plurality of first delivery lines fluidly coupled to the first chamber, a dispense nozzle fluidly coupled to the second chamber, a second delivery line fluidly coupled to the second chamber, and a valve disposed between the first and second chambers. Here, fluid communication between the first chamber and the second chamber is controlled by the valve disposed therebetween. Polishing fluid components are flowed into the first chamber through the plurality of first delivery lines fluidly coupled thereto to form a batch of polishing fluid. Once formed, the batch of polishing fluid is transferred to the second chamber by opening the valve. Typically, the valve is then closed and the transferred batch can be delivered to a polishing pad through the dispense nozzle fluidly coupled to the second chamber, often by pressurizing the second chamber using pressurized gas delivered thereinto through the second delivery line.

20 Claims, 6 Drawing Sheets

(56) References Cited

U.S. PATENT DOCUMENTS 4,012,173 A 3/1977 Everson, Jr.
4,253,501 A 3/1981 Ogle
4,279,360 A 7/1981 Hauser
4,741,623 A 5/1988 Haeuser et al.
5,664,990 A 9/1997 Adams et al.
5,803,599 A * 9/1998 Ferri, Jr. ..... B01F 15/00422 137/205
5,873,705 A 2/1999 Chen
6,027,240 A * 2/2000 Han ..... B01F 3/0803 137/579
6,280,299 B1 8/2001 Kennedy et al.
6,336,850 B1 * 1/2002 Wada ..... B24B 37/04 451/287
6,348,124 B1 2/2002 Garbett et al.
6,358,125 B2 3/2002 Kawashima et al.
6,544,109 B1 4/2003 Moore
6,570,524 B1 5/2003 Mullaly et al.
6,616,014 B1 9/2003 Pozniak et al.
6,659,848 B1 12/2003 Craig et al.
6,789,699 B2 9/2004 Clark et al.
6,802,762 B2 10/2004 Tanaka et al.
6,910,954 B2 6/2005 Kim et al.
6,955,764 B2 10/2005 Kobayashi
7,054,719 B2 5/2006 Pham et al.
7,225,946 B2 6/2007 Gardos
7,335,003 B2 2/2008 Kingsford et al.
7,743,783 B2 6/2010 Edwards
7,784,994 B2 8/2010 Wakefield et al.
7,850,431 B2 12/2010 Gonnella et al.
7,878,765 B2 2/2011 Gonnella et al.
7,897,196 B2 3/2011 Rone et al.
8,025,486 B2 9/2011 Gonnella et al.
8,029,247 B2 10/2011 Cedrone et al.
8,083,498 B2 12/2011 Gonnella et al.
8,087,429 B2 1/2012 Cedrone et al.
8,172,546 B2 5/2012 Cedrone et al.
8,191,733 B2 6/2012 Seppanen
8,292,598 B2 10/2012 Laverdiere et al.
8,297,830 B2 10/2012 Tseng et al.
9,211,539 B2 12/2015 Amin et al.
9,278,367 B2 3/2016 Cooper
9,695,985 B2 7/2017 Hodges et al.
9,770,804 B2 9/2017 Byers et al.
2002/0179224 A1 12/2002 Brynolf et al.
2003/0010792 A1 * 1/2003 Forshey ..... B67D 7/0272 222/56
2003/0132417 A1 7/2003 Kobayashi
2003/0189060 A1 10/2003 Osterheld et al.
2003/0192920 A1 10/2003 Forshey et al.
2005/0272352 A1 12/2005 Polyak et al.
2006/0207777 A1 9/2006 Kim et al.
2008/0076332 A1 3/2008 Serafin et al.
2010/0081213 A1 4/2010 Lee et al.
2011/0008964 A1 * 1/2011 Hughes ..... H01L 21/3212 438/692
2011/0082580 A1 4/2011 Philippe et al.
2012/0039147 A1 2/2012 Greter et al.
2014/0144471 A1 5/2014 Kahlon et al.
2014/0261824 A1 9/2014 Byers et al.
2015/0114480 A1 4/2015 Hertel
2015/0117135 A1 4/2015 Chen et al.
2015/0140485 A1 5/2015 Sasa et al.
2016/0089646 A1 * 3/2016 Lin ..... B01F 35/214 137/896
2016/0103453 A1 4/2016 Hill
2016/0125980 A1 5/2016 Hirabayashi et al.

* cited by examiner

SMALL BATCH POLISHING FLUID DELIVERY FOR CMP

CROSS-REFERENCE TO RELATED APPLICATIONS

This application claims benefit of U.S. provisional patent application Ser. No. 62/926,097, filed Oct. 25, 2019, which is herein incorporated by reference in its entirety.

BACKGROUND

Field

Embodiments described herein generally relate to chemical mechanical polishing (CMP) of a substrate in an electronic device fabrication process. In particular, embodiments herein relate to apparatus and methods for mixing small batches of polishing fluids to be used in a CMP process, e.g., 200 ml or less, at or proximate to the point of use.

Description of the Related Art

Chemical mechanical polishing (CMP) is commonly used in the manufacturing of high-density integrated circuits to planarize or polish a layer of material deposited on a substrate. In a typical CMP process, a substrate is retained in a carrier head that presses the backside of the substrate towards a rotating polishing pad in the presence of a polishing fluid. Material is removed across the material layer surface of the substrate in contact with the polishing pad through a combination of chemical and mechanical activity which is provided by the polishing fluid and a relative motion of the substrate and the polishing pad.

Typical polishing fluids comprise an aqueous solution of one or more chemical components and nanoscale abrasive particles suspended in the aqueous solution which form a polishing slurry. Often, the polishing fluid composition is specific to the desired CMP application. For example, for a metal CMP application such as copper CMP, the polishing fluid may include one or more complexing agents, one or more inhibitors, one or more oxidizers, abrasive particles, and one or more pH tuning additives.

Careful formulation of the polishing fluid composition is necessary as, depending on the chemical components and the pH of the polishing fluid, an unstable composition may result in undesirable agglomerations of the abrasive particles. In an unstable composition these agglomerations can form over hours or even minutes and may adversely impact the CMP process by causing micro-scratches to the surface of the substrate thus reducing the number of operable devices which would otherwise be yielded therefrom. Thus, the composition of a polishing fluid may be undesirably limited by the need to provide a colloidally stable suspension or a near colloidally stable suspension which may be used with a conventional bulk or point of use fluid distribution system. A near colloidally stable suspension includes polishing fluids where sedimentation of the abrasive particles contained therein may be prevented or reversed by mechanical agitation, e.g., stirring or recirculation of the polishing fluid within a fluid distribution system.

Nonetheless, some CMP processes would benefit from polishing fluid mixtures that would be considered colloidally unstable over hours or even over minutes so long as the polishing fluid mixture could be used before agglomeration and/or sedimentation of the abrasive particles suspending therein.

Accordingly, there is a need in the art for small batch point of use polishing fluid delivery apparatus, and methods related thereto, which may be used to deliver a polishing fluid to a substrate polishing pad interface within seconds of combining the individual components thereof.

SUMMARY

Embodiments herein generally include fluid delivery apparatus, and methods related thereto, which may be used to concurrently form batches of polishing fluid and dispense batches of polishing fluids to a polishing pad within minutes of the formation thereof.

In one embodiment a polishing fluid delivery system features a fluid delivery apparatus. The fluid delivery apparatus includes a vessel body having a first chamber and a second chamber disposed therein, a plurality of first delivery lines fluidly coupled to the first chamber, a dispense nozzle fluidly coupled to the second chamber, a second delivery line fluidly coupled to the second chamber, and a valve disposed between the first and second chambers. Here, fluid communication between the first chamber and the second chamber is controlled by the valve disposed therebetween. Polishing fluid components are flowed into the first chamber through the plurality of first delivery lines fluidly coupled thereto to form a batch of polishing fluid. Once formed, the batch of polishing fluid is transferred to the second chamber by opening the valve. Typically, the valve is then closed and the transferred batch can be delivered to a polishing pad through the dispense nozzle fluidly coupled to the second chamber, often by pressurizing the second chamber using pressurized gas delivered thereinto through the second delivery line.

In another embodiment, a method of polishing a substrate includes flowing a plurality of polishing fluid components into a chamber of a fluid delivery apparatus to form a first batch of polishing fluid. Here, the fluid delivery apparatus is disposed in, on, or coupled to a portion of a fluid delivery arm positioned over a polishing pad. The method further includes dispensing the first batch of polishing fluid onto the polishing pad and forming a second batch of polishing fluid concurrent with dispensing the first batch of polishing fluid. In some embodiments, the method is performed using instructions stored on a non-transitory computer readable medium.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure provide for fluid batch delivery apparatus, and methods related thereto, which may be used to form batches of polishing fluids from a plurality of polishing fluid components and to deliver the polishing fluid batches to a polishing interface of a substrate and a polishing pad. In some embodiments, the fluid delivery apparatus is sized to mix small volume batches of a polishing fluid, herein a batch of about 200 ml of polishing fluid or less, and is positioned so that substantially all of the small volume batch can be delivered to the polishing interface within seconds of the mixing thereof, such as within 60 seconds or less.

In a typical polishing process a dispense rate of an abrasive-containing polishing fluid onto the surface of the polishing pad may be between about 150 ml/min and about 200 ml/min. To provide substantially all of a batch of polishing fluid to a polishing interface within minutes or seconds of mixing the components thereof, the small fluid delivery apparatus may be sized to form and dispense batches of polishing fluid that are about 100 ml or less, such as 50 ml or less. Typically, in those embodiments the small fluid delivery apparatus will be disposed in a fluid delivery arm which may be positioned over polishing pad to dispense polishing and other fluid there onto. Thus, the small fluid delivery apparatus described herein may be beneficially used to mix a small volume batch of a colloidally unstable polishing fluid and deliver substantially all of the small volume batch to a polishing interface before undesirable agglomeration of the abrasive particles suspended therein can occur.

Figure 1A:
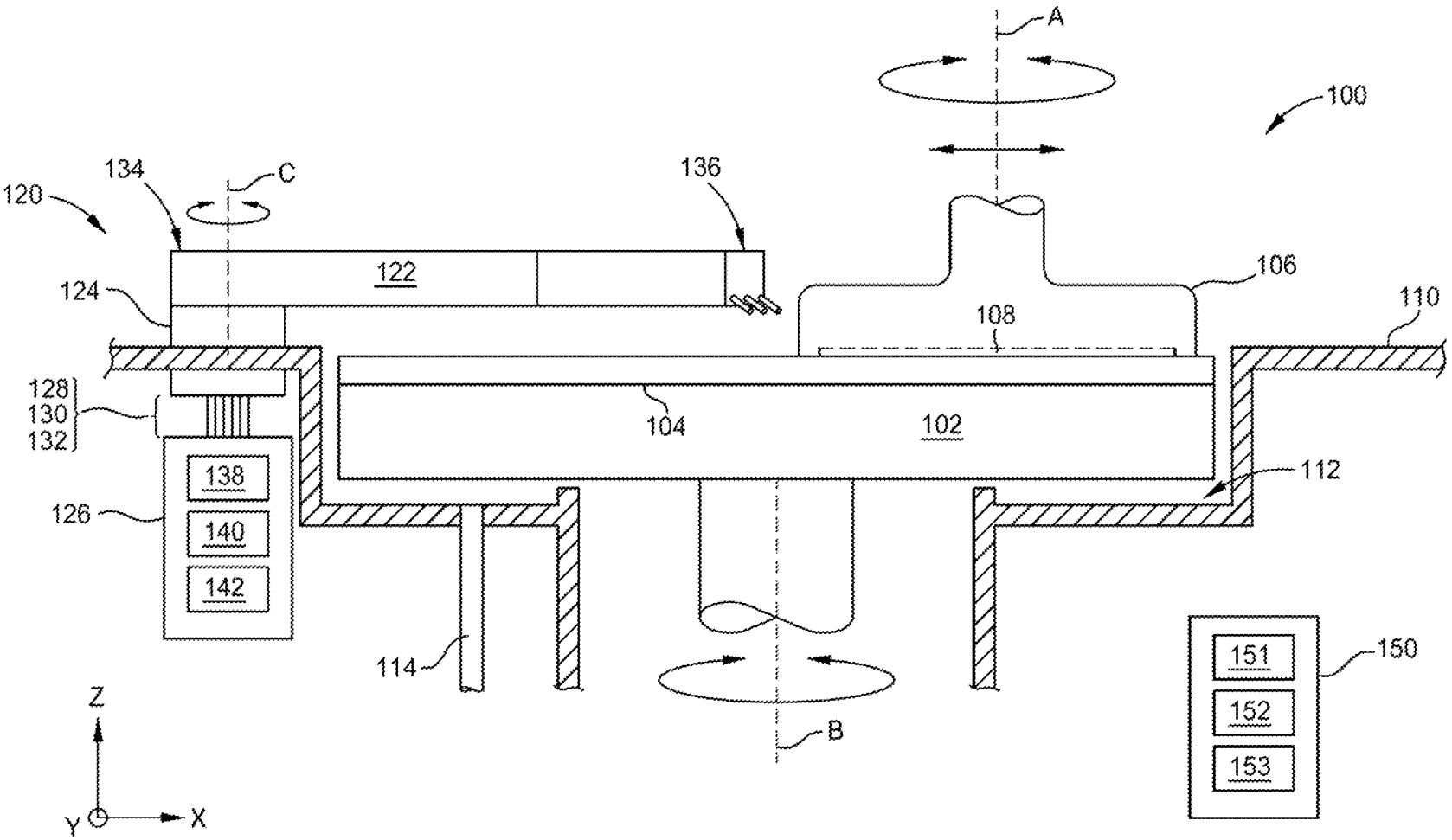
FIG. 1A is a schematic side view of an exemplary polishing system which may be used to practice the methods set forth herein, according to one embodiment.
Figure 1B:
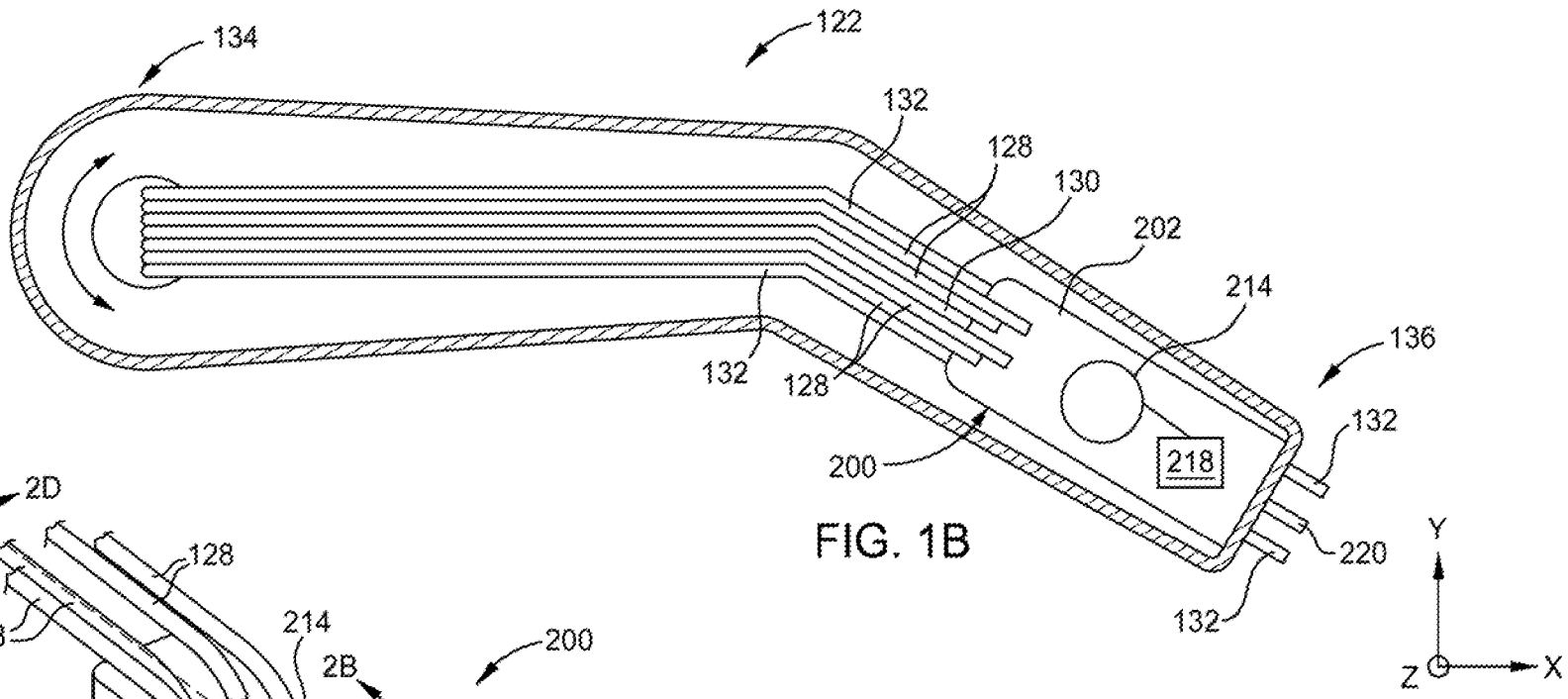
FIG. 1B is a schematic top down sectional view of a fluid delivery arm, according to one embodiment, which may be used with the polishing system set forth in FIG. 1A.

FIG. 1A is a schematic side view of an exemplary polishing system which may be used to practice the methods set forth herein, according to one embodiment. FIG. 1B is a top down sectional view of the fluid delivery arm shown in FIG. 1A.

Here, the polishing system 100 includes a platen 102, a polishing pad 104 disposed on the platen 102 and secured thereto, and a substrate carrier 106. The substrate carrier 106 faces the platen 102 and the polishing pad 104 mounted thereon. The substrate carrier 106 is used to urge a material surface of a substrate 108, disposed therein, against the polishing surface of the polishing pad 104 while simultaneously rotating about a carrier axis A. Here, the platen 102 rotates about a platen axis B while the rotating substrate carrier 106 sweeps back and forth from an inner diameter to an outer diameter of the platen 102 to, in part, reduce uneven wear of the polishing pad 104. In some embodiments, the polishing system 100 further includes a pad conditioning assembly (not shown). The pad conditioning assembly typically features a brush or a fixed abrasive conditioning disk (not shown) which may be urged against the polishing pad 104 to rejuvenate the surface thereof and/or remove polishing byproducts or other debris therefrom.

Typically, the platen 102 is surrounded by a base plate 110 (shown in cross section) where at least a portion of the base plate 110 defines a drainage basin 112. The drainage basin 112 is used to collect fluids spun radially outward from the platen 102 and drain the fluids through a drain 114 in fluid communication therewith.

Herein, the one or more polishing fluids are delivered to the polishing pad 104 before and during polishing of the substrate 108 using the fluid delivery system 120. The fluid delivery system 120 includes a delivery arm 122, an actuator 124, a fluid source 126, a plurality of fluid delivery lines 128, 130, 132, and a fluid delivery apparatus 200 (shown in FIG. 1B).

The delivery arm 122 comprises a first end 134 and a second end 136. The first end 134 is coupled to the actuator 124 which is used to position the second end 136 of the delivery arm 122 over the polishing pad 104 by swinging the delivery arm 122 about the actuator axis C. Typically, the actuator 124 is disposed on and/or through the base plate 110 in a location that is proximate to the polishing platen 102. The delivery arm 122 may form an angle between the first end 134 and the second end 136 (as shown in FIG. 1B), may be curved between the first end 134 and the second end 136, or may be generally straight between the first end 134 and the second end 136.

The fluid source 126 provides various polishing fluids and polishing fluid components, deionized water (DI water), and pressurized gases to the fluid delivery apparatus 200 using a plurality of delivery lines 130, 132 fluidly coupled therebetween. The term "fluidly coupled" as used herein refers to two or more elements that are directly or indirectly connected such that the two or more elements are in fluid communication, i.e., such that a fluid may directly or indirectly flow therebetween. Typically, the fluid source 126 comprises one or a combination of a plurality of valves 138 and a plurality of flow controllers 140 which measure and control the flow and, or, flowrate of the polishing fluid components, DI water, and pressurized gases therethrough. In some embodiments, the fluid source 126 is further coupled to one or more delivery lines 132 which bypass the fluid delivery apparatus 200 to deliver fluids, e.g., DI water, premixed polishing fluids, and/or cleaning fluids directly to the polishing pad 104. In some embodiments, the fluid source 126 further includes one or more pumps, such peristaltic pumps, operable to deliver polishing fluid components to the fluid delivery apparatus 200.

Operation of the polishing system 100, including operation and control of the valves 138 and flow controllers 140 of the fluid source 126 and operation and control of the fluid delivery apparatus 200 is facilitated by a system controller 150.

The system controller 150 herein includes a programmable central processing unit (CPU) 151 which is operable with a memory 152 (e.g., non-volatile memory) and support circuits 153. The support circuits 153 are conventionally coupled to the CPU 151 and comprise cache, clock circuits, input/output subsystems, power supplies, and the like, and combinations thereof coupled to the various components the polishing system 100, to facilitate control of a substrate polishing process. For example, in some embodiments the CPU 151 is one of any form of general purpose computer processor used in an industrial setting, such as a programmable logic controller (PLC), for controlling various polishing system component and sub-processors. The memory 152, coupled to the CPU 151, is non-transitory and is typically one or more of readily available memory such as random access memory (RAM), read only memory (ROM), floppy disk drive, hard disk, or any other form of digital storage, local or remote.

Herein, the memory 152 is in the form of a computer-readable storage media containing instructions (e.g., non-volatile memory), that when executed by the CPU 151, facilitates the operation of the polishing system 100. The instructions in the memory 152 are in the form of a program product such as a program that implements the methods of the present disclosure (e.g., middleware application, equipment software application etc.). The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure.

Figure 2A:
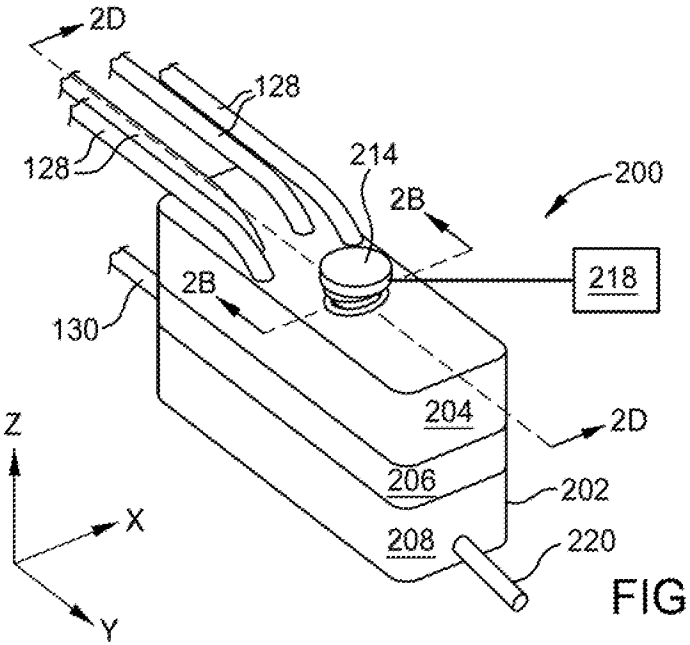
FIG. 2A is a schematic isometric view of the small fluid delivery apparatus shown in FIG. 1B, according to one embodiment.
Figure 2C:
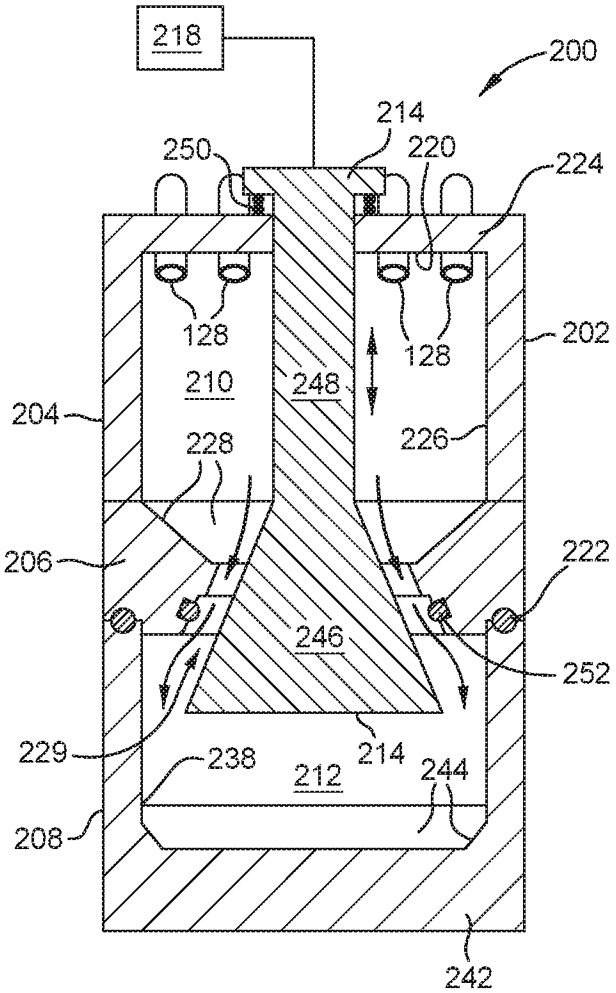
FIGS. 2B-2C are schematic sectional views of the small fluid delivery apparatus shown in FIG. 2A taken along line 2B-2B.
Figure 2B:
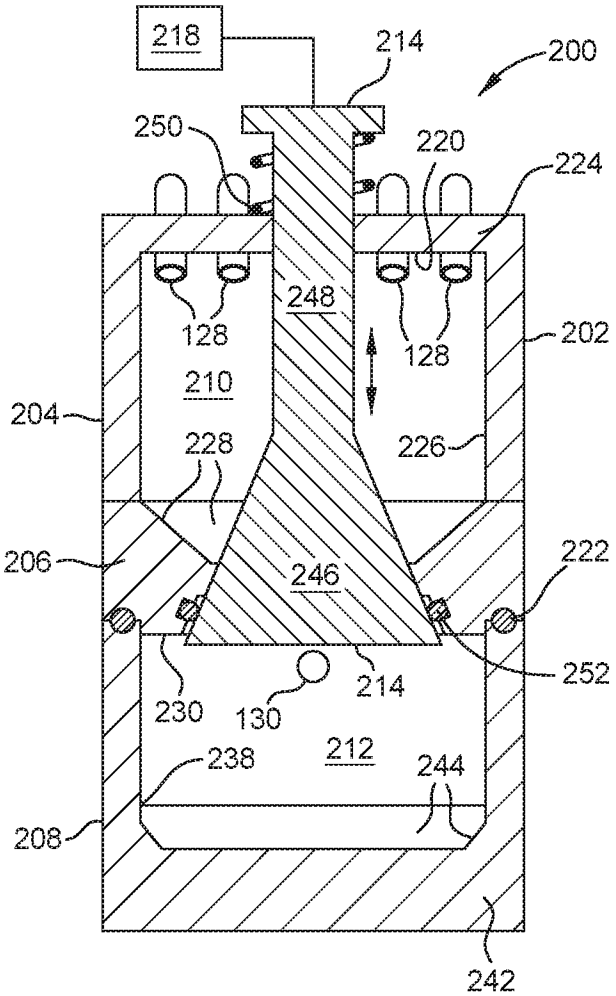
Figure 2D:
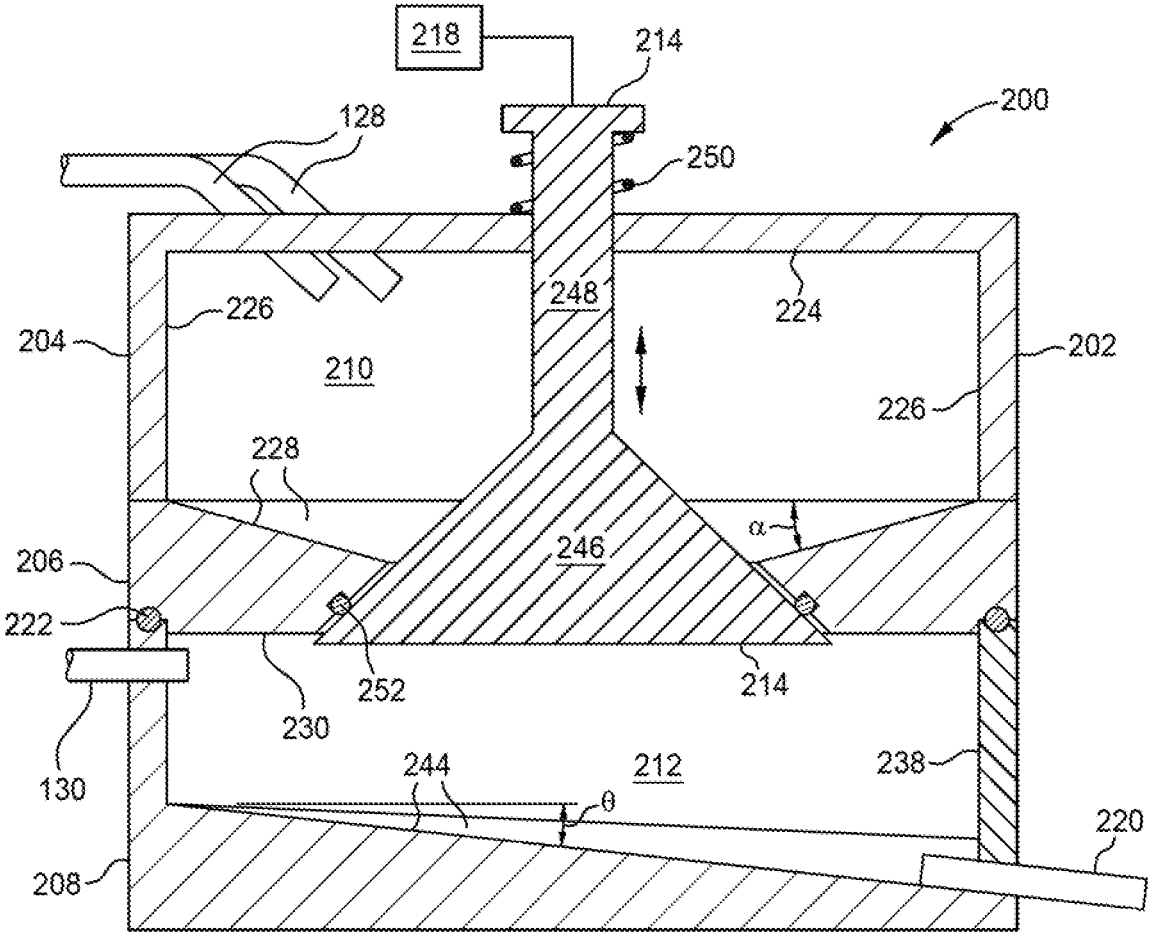
FIG. 2D is a schematic sectional view of the small fluid delivery apparatus shown in FIG. 2A taken along line 2D-2D.

FIG. 2A is a schematic isometric view of the fluid delivery apparatus 200 used with the polishing system 100 set forth in FIGS. 1A-1B, according to one embodiment. FIGS. 2B-2C are schematic sectional views of the fluid delivery apparatus 200 shown in FIG. 2A taken along line 2B-2B. FIG. 2D is a schematic sectional view of the fluid delivery apparatus 200 shown in FIG. 2A taken along line 2D-2D.

Here, the fluid delivery apparatus 200 features a vessel body 202 which is described below with reference to portions 204, 206, 208. The vessel body 202 has at least two chambers disposed therein, here a mix chamber 210 and a dispense chamber 212, and a valve 214 disposed between the mix chamber 210 and the dispense chamber 212. The mix chamber 210, the dispense chamber 212, and the valve 214 are shown in the sectional views of FIGS. 2B-2D. Typically, polishing fluid components and/or DI water are flowed into the mix chamber 210 through the delivery lines 128 fluidly coupled thereto. In some embodiments at least one of the delivery lines 128 is open to atmosphere at an end distal from the fluid delivery apparatus 200 to provide a vent to the mix chamber 210.

The fluid delivery apparatus 200 further includes an actuator 218 coupled to the valve 214 for controlling the operation thereof. The valve 214 is used to control fluid communication between the mix chamber 210 and the dispense chamber 212 and is further described below. When the valve 214 is disposed in a closed position, as shown in FIGS. 2B and 2D, the mix chamber 210 will be fluidly isolated from the dispense chamber 212. When the valve 214 is disposed in an open position, as shown in FIG. 2C, the mix chamber 210 and the dispense chamber 212 will be in fluid communication so that fluids may gravity flow from the mix chamber 210 to the dispense chamber 212.

Typical operation of the fluid delivery apparatus 200 comprises forming a small volume batch of polishing fluid in the mix chamber 210 and concurrently dispensing a previously formed small volume batch of polishing fluid onto a polishing pad from the dispense chamber 212. For example, in one embodiment desired volumes of polishing fluid components are flowed into the mix chamber 210 through the respective delivery lines 128 to form a first batch of polishing fluid. Once formed, the first batch of polishing fluid is transferred into the dispense chamber 212 by opening the valve 214, such as shown in FIG. 2C. The valve 214 is typically closed after the first batch of polishing fluid is transferred so that the dispense chamber 212 and the first batch of polishing fluid may be dispensed onto a polishing pad through a dispense nozzle 220 fluidly coupled to the dispense chamber 212. While the first batch of polishing fluid is dispensed from the dispense chamber 212 a second batch of the polishing fluid of the same or a different composition may be concurrently formed in the mix chamber 210.

In some embodiments, dispensing a batch of polishing fluid includes pressurizing the dispense chamber 212. Here, pressurizing the dispense chamber 212 typically comprises delivering a pressurized gas thereinto through a delivery line 130 fluidly coupling the dispense chamber 212 to a fluid source, such as the fluid source 126 of FIG. 1A. In other embodiments, the delivery line 130 is open to atmosphere at an end distal from the vessel body 202 and is used to vent the dispense chamber 212. Venting the dispense chamber 212 allows polishing fluids to continue to gravity flow therefrom through the dispense nozzle 220 when the valve 214 is disposed in a closed position.

The multi-chamber configuration of the fluid delivery apparatus 200 beneficially allows for concurrent mixing and dispensing of batches of polishing fluid to provide a near continuous flow of polishing fluid to the polishing pad. The alternating sequence of small batch blending and delivery is continued by opening and closing the valve 214 during at least a portion of the polishing process. Herein, "blending," "mixing," and "forming" batches of polishing fluid in the mix chamber 210 includes alternately, concurrently, and/or sequentially flowing polishing fluid components thereinto and does not necessarily include the use of a mechanical agitator, such as a stirrer.

The vessel body 202 may be formed of any suitable material using any suitable method. Here, the vessel body 202 includes a first portion 204, a second portion 206, and a third portion 208. The second portion 206 is interposed between the first portion 204 and the third portion 208. The first portion 204 features a vessel ceiling 224 and one or more sidewalls 226 extending downwardly from the vessel ceiling 224. The second portion 208 features one or more first surfaces 228 and one or more second surfaces 230 disposed opposite of the one or more first surfaces 232. The vessel ceiling 224, the one or more sidewalls 226, and the one or more first surfaces 228 collectively define the mix chamber 210. An opening 234 disposed through the second portion 206 enables fluid communication between the mix chamber 210 and the dispensing chamber 212 when the valve 214 is disposed in an open position. The walls of the opening 234 are shaped to provide a seat for the valve 214 when the valve 214 is disposed in a closed position.

Typically, the one or more first surfaces 228 of the second portion 206 are sloped downwardly towards the opening 234 to encourage the flow of polishing fluid theretowards and to prevent any residual polishing fluids from remaining in the first chamber once the valve 214 has been opened. For example, here one or more first surfaces 228 of the second portion 206 form an angle α with a horizontal plane (the horizontal plane being orthogonal to the direction of gravity) when the vessel body 202 is mounted on or coupled to a fluid delivery arm. In some embodiments, the angle α (FIG. 2D) is between about 5° and about 40°, such as between about 10° and 30°, or between about 10° and about 20°, or more than 10°. Here, the first and second portions 204 and 206 are separately formed and assembled using a polymer welding method. In other embodiments, the first and second portions 204, 206 may be assembled using a sealing ring disposed therebetween and one or more fasteners.

The third portion 208 features a vessel base 236 and one or more sidewalls 238 extending upwardly from the vessel base 236. The one or more second surfaces 230, the vessel base 244, and the one or more sidewalls 238 collectively define the dispense chamber 212. Here, the inner surfaces of the vessel base 244 are sloped downwardly towards the dispense nozzle 220 to encourage the flow of fluids thereinto and to prevent any residual polishing fluid from undesirably accumulating in the dispense chamber 212. For example, here one or more surfaces second surfaces 228 of the third portion 208 form an angle Θ (FIG. 2D) with a horizontal plane (the horizontal plane being orthogonal to the direction of gravity) when the vessel body 202 is mounted on or coupled to a fluid delivery arm. In some embodiments, the angle Θ is between about 5° and about 40°, such as between about 10° and 30°, or between about 10° and about 20°, or more than 10°.

Here, the vessel body 202 is of a size and shape that allows the fluid delivery apparatus 200 to be coupled to or disposed on a portion of a polishing delivery arm which will be positioned over a polishing pad. For example, in some embodiments the combined volume of the mix chamber 210 and the dispense chamber 212 is about 200 ml or less, such as about 150 ml or less, about 100 ml or less, or about 80 ml or less. The volume of the dispense chamber 212 is typically greater than the volume of the mix chamber 210 to facilitate complete drainage of small polishing fluid batches from the mix chamber 210 during batch transfer therebetween. For example, the volume of the dispense chamber 212 may be between about 5 ml and about 30 ml greater than the volume of the mix chamber 210. The vessel body 202 may comprise any desired shape, such as the generally rectangular sectional shape shown herein or any other shape suitable for mounting the fluid delivery apparatus 200 on or in a fluid delivery arm or coupling the fluid delivery apparatus 200 thereto.

Typically, the vessel body 202 is formed of a polishing fluid chemical resistant material having a hydrophobic surface. Examples of suitable materials include polishing fluid chemical resistant polymers, such as one or more fluorine-containing polymers (fluoropolymer), for example perfluoroalkoxy (PFA), fluorinated ethylene propylene (FEP), polytetrafluoroethylene (PTFE) commercially available as TEFLON® from DuPont, or combinations thereof. One or more portions 204, 206, 208 of the vessel body 202 may be formed separately from the other portion, e.g., by machining or molding, and assembled therewith using any suitable method, e.g., with fasteners (not shown) and sealing rings 222 and/or by direct bonding, e.g., by a polymer welding method, or by a combination thereof.

The delivery lines 128 and 130 and the dispense nozzle 220 may be fluidly coupled to the vessel body 202 by any suitable method, e.g., using a fluorine-containing polymer fitting, such as a fluorine-containing polymer fitting commercially available from SMC Corporation of America of Noblesville, Ind., by a polymer welding method, or by combinations thereof. In some embodiments one or more of the delivery lines is sized so that once fluid flow is stopped from the fluid source, capillary action will prevent or substantially limit further fluid flow therefrom, e.g., undesirable droplets or drips from an opening of the delivery line 128. In some embodiments one or more of the fluid delivery lines 128 has an inner diameter of about 3.5 mm or less, such as about 3 mm or less, 2.5 mm or less, 2 mm or less, for example 1.75 mm or less.

The valve 214 features a base portion 246 and a stem 248 extending upwardly from the base portion 246. Upper surfaces of the base portion 246 are typically sloped downwardly from the stem 248 towards the opening 229 to prevent residual polishing fluids from accumulating thereon. The stem 248 is movably disposed through the vessel ceiling 224 and is coupled to the actuator 218 which may be used to toggle the valve 214 between the open and closed positions described above. In some embodiments, a spring 250 is used to maintain the valve 214 in a closed position when the valve 214 is not being pushed downward into an open position by the actuator 218. Typically, a sealing ring 252 is disposed about the opening 229 in the second portion 206 to prevent fluid from flowing from the mix chamber 210 to the dispense chamber when the valve 214 is in a closed position. The valve 214 may be made of the same or a different polishing fluid chemical resistant material as the vessel body 202, such as one or more of the fluoropolymers described above.

Figure 3A:
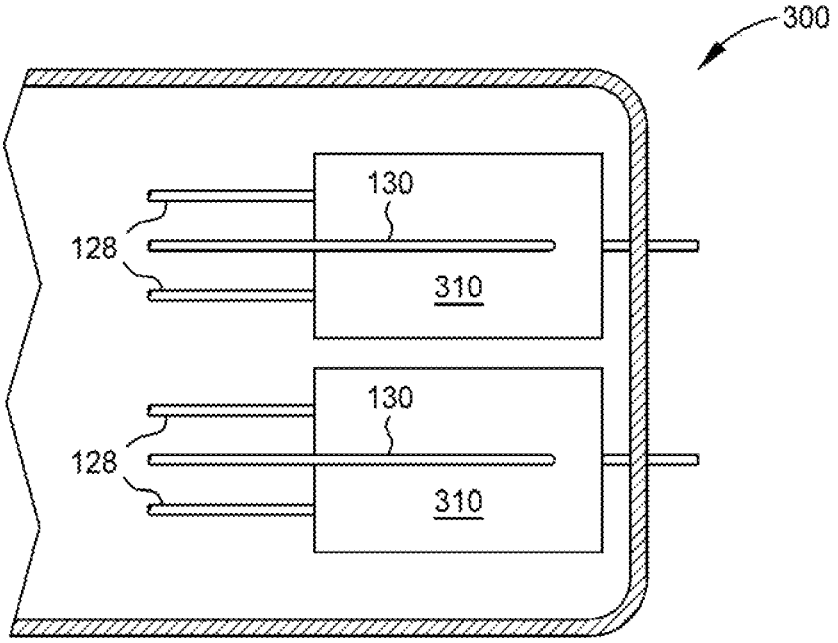
FIG. 3A is a schematic top down sectional view of a portion of a fluid delivery arm, according to an alternate embodiment, which may be used with the polishing system of FIG. 1A.

FIG. 3A is a schematic top down sectional view of a portion of a fluid delivery arm 300, according to an alternate embodiment, which may be used with the polishing system 100 of FIG. 1A in place of the delivery arm 122. The delivery arm 300 features a plurality of fluid delivery apparatus 310 (two shown) disposed on, in, or coupled to the delivery arm 300 between the ends thereof. Here, each of the two fluid delivery apparatus 310 comprise a single chamber to be used for sequentially forming a small volume batch of polishing fluid and then dispensing the small volume batch of polishing fluid onto a polishing pad.

The plurality of fluid delivery apparatus 310 may be used concurrently to provide a continuous flow of polishing fluid onto a polishing pad. For example, a first one of the plurality of fluid delivery apparatus 310 may be used to dispense a first batch of polishing fluid while a second one of the plurality of the fluid delivery apparatus 310 is used to concurrently form a second batch of to-be-dispensed polishing fluid. Once the first batch of polishing fluid is fully dispensed, the first one of the plurality of delivery apparatus 310 may be used to form a third batch of polishing fluid while the second batch of polishing fluid is concurrently dispensed onto the polishing pad from the second one of the plurality of fluid delivery apparatus 310. Sequential repetitions of forming and dispensing batches of polishing fluid from one fluid delivery apparatus 310 while concurrently and respectively dispensing and forming batches of polishing fluid from another fluid delivery apparatus 310 may be continued for the length of a polishing process. The composition of the batches of polishing fluid may be the same or may change throughout the polishing process.

Figure 3B:
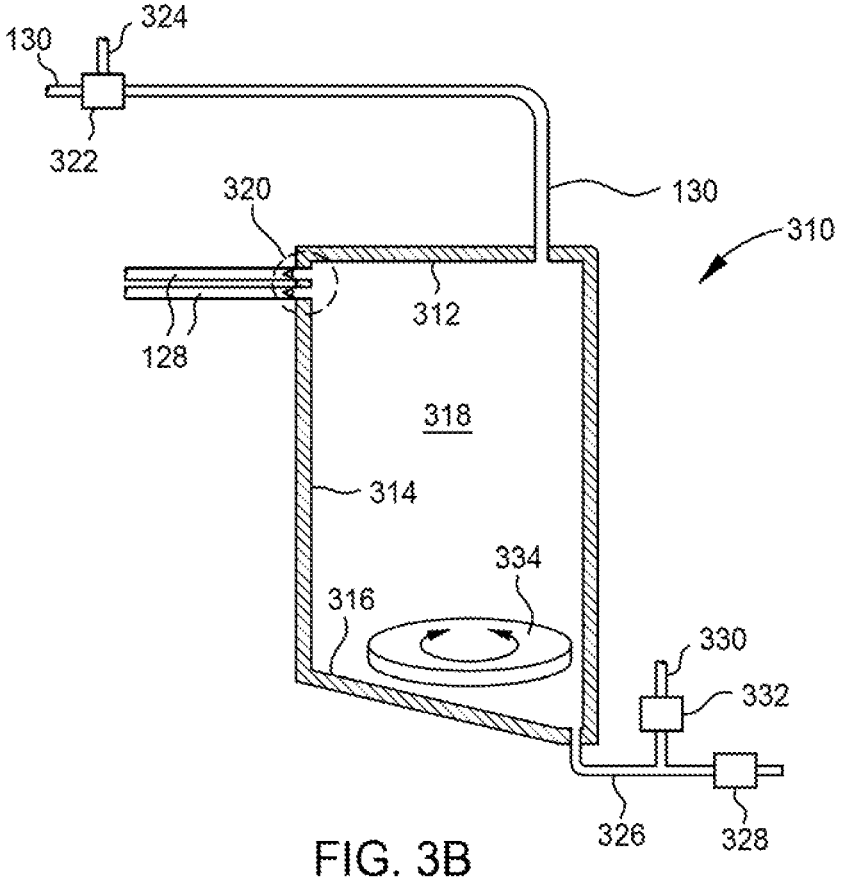
FIG. 3B is a schematic cross-sectional view of one of the fluid delivery apparatus of FIG. 3A.

FIG. 3B is a schematic cross-sectional view of one of the fluid delivery apparatus 310 of FIG. 3A. Here, the delivery apparatus 310 includes a vessel body comprising a vessel ceiling 312, sidewalls 314, and a base 316 which collectively define a chamber 318. The delivery apparatus 310 may be operated in at least two alternating modes. In the first mode, a batch of polishing fluid is formed in the chamber 318 by flowing a plurality of polishing fluid components thereinto through a corresponding plurality of delivery lines 128. In the second mode, the batch of polishing fluid formed during the first mode may be dispensed onto a polishing pad by flowing the batch of polishing fluid through a dispense line 326. Typically, the chamber 318 is vented during the first mode to allow the polishing fluid components to flow thereinto. In the second mode the chamber 318 may be pressurized to facilitate and/or control the flow of the batch of polishing fluid therefrom. When the chamber 318 is pressurized, check valves 320 respectively disposed on the first delivery lines 128 will prevent the pressurized gas and/or the batch of polishing fluid from flowing into the delivery lines 128. In some embodiments, a valve 322 disposed between the chamber 318 and the pressurized gas source may be used to vent the chamber 318 by fluidly coupling the chamber 318 to a vent line 324 which is open to atmosphere at one end thereof.

Here, the base 316 slopes downwardly towards the dispense line 326. In some embodiments, a valve 328 on the dispense line 326 may be used to control the flow of polishing fluid therethrough. In some embodiments, the dispense line 326 is further coupled to a gas source, e.g., an inert gas source such as $N_2$, through a third delivery line 330. In those embodiments, the delivery system may further include an gas bubbler 332 disposed on the third delivery line 330 which may be used to form a bubble layer on the surface of the polishing fluid as the polishing fluid is dispensed onto a polishing pad. The gas bubbler 332 and third delivery line 330 may be used with any of the delivery apparatus described herein. In some embodiments, the fluid delivery apparatus 310 further includes a mechanical agitator 334, such as a stirrer or impeller, disposed in the chamber 318 which may be used to mix or blend the polishing fluid components flowed thereinto.

Figure 4:
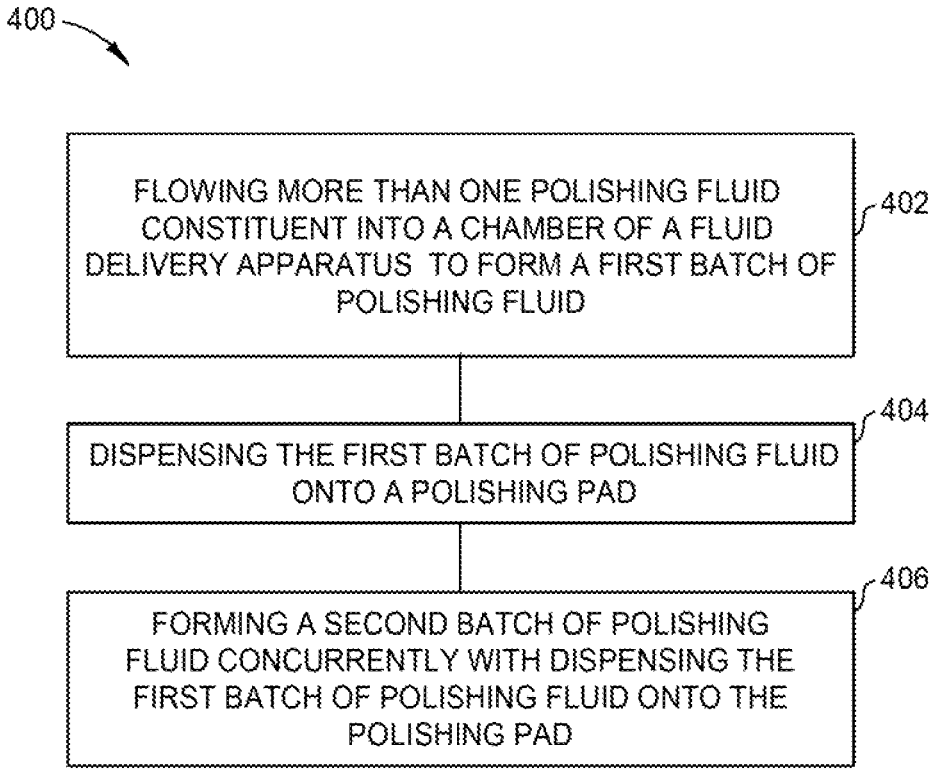
FIG. 4 is a flow diagram setting forth a method of processing a substrate using a small volume mixing apparatus, according to one embodiment.

FIG. 4 is a flow diagram setting forth a method 400 of delivering small volume batches of polishing fluid to a polishing pad using one or a combination of the polishing fluid delivery systems set forth herein.

At activity 402 the method 400 includes flowing a plurality of polishing fluid components into a chamber of a fluid delivery apparatus to form a first batch of polishing fluid. Here, the fluid delivery apparatus is disposed in or on a portion of a fluid delivery arm positioned over a polishing pad of a polishing system. In some embodiments, the polishing fluid components are flowed into a first chamber of a multi-chamber fluid delivery apparatus, such as the multi-chamber fluid delivery apparatus set forth in FIGS. 2A-2C. In some embodiments, the polishing fluid components are flowed into a first fluid delivery apparatus of a plurality of fluid batch delivery apparatus, such as set forth in FIGS. 3A-3B. In other embodiments, the fluid delivery apparatus or the plurality of fluid delivery apparatus are not disposed in or on the fluid delivery arm and are instead disposed in a portion of a fluid delivery system proximate to the delivery arm. For example, in some embodiments the fluid delivery apparatus or the plurality of fluid delivery apparatus are disposed above or below a base plate of a polishing system proximate to an actuator used to move the delivery arm.

Typically, the polishing fluid components include an abrasive-containing solution and one or more polishing fluid additives, such as complexing agents, corrosion inhibitors, oxidizing agents, pH adjusters and/or buffers, polymeric additives, passivation agents, accelerators, surfactants, and combinations thereof. The abrasive-containing solution is typically a colloidally stable or near colloidally stable solution comprising nanoscale silica, or metal oxide particles, such as aluminum oxides, cerium oxides, zirconium oxides, titanium oxides, iron oxides, combinations thereof and/or composites thereof, such as polymer coated silica or metal oxide particles.

The polishing fluid components are flowed into the chamber through a plurality of fluid delivery lines fluidly coupled to the chamber. In embodiments where the fluid delivery apparatus is a multi-chamber fluid batch delivery apparatus, such as described in FIGS. 2A-2D, the polishing fluid components are flowed into a first chamber through a plurality of fluid delivery lines fluidly coupled to the first chamber.

In some embodiments, at least one of the fluid delivery lines is fluidly coupled to a polishing fluid source comprising a polishing fluid component that is different from a polishing fluid component provided by one of the other fluid delivery lines. In some embodiments, one or more of the fluid delivery lines are fluidly coupled to a DI water source. In some embodiments, the polishing fluid components are co-flowed into the chamber to facilitate the mixing thereof.

In some embodiments, the first batch comprises a colloidally unstable mixture having a useful lifetime of about 3 hours or less, about 2 hours or less, about 1 hour or less, about 30 minutes or less, or about 15 minutes or less. Typically, a magnitude of a zeta potential of the colloidally unstable mixture is less than a magnitude of a colloidally stable or near colloidally stable abrasive-containing polishing fluid component used to form the first batch. Zeta potential is a measure of the magnitude of the electrostatic or charge repulsion/attraction between abrasive particles dispersed in a fluid medium and may be used to measure the stability of a suspension. Larger zeta potentials indicate increased repulsive forces between the abrasive particles and are there indicative of increased colloidal stability. This, in embodiments where the first batch comprises a colloidally unstable mixture an absolute zeta potential of the first batch of polishing fluid may be less than an absolute zeta potential of the abrasive-containing polishing fluid component used to form the first batch. For example, in the absolute zeta potential of the first batch of polishing fluid may be about 80% or less, about 60% or less, or about 50% or less than the absolute valve of the zeta potential of an abrasive-containing polishing fluid component flowed into the chamber.

At activity 404 the method 400 includes dispensing the first batch of polishing fluid onto the polishing pad. In some embodiments, dispensing the first batch of polishing fluid onto the polishing pad includes pressurizing the chamber by providing a pressurized gas, such as CDA or $N_2$, thereinto. Typically, a duration between forming a batch of polishing fluid and then dispensing the batch of polishing fluid onto the polishing pad is about 5 minutes or less, such within about 4 minutes or less, within 3 minutes or less, within 2 minutes or less, or within 1 minute or less. Herein, the duration is measured from the point when at least two different polishing components begin to flow into a chamber to form a batch of polishing fluid to a point where substantially all of the batch of polishing fluid has been dispensed onto the polishing pad.

In embodiments where the fluid delivery apparatus is a multi-chamber fluid batch delivery apparatus, the method further includes transferring the first batch of polishing fluid to a second chamber of the multi-chamber fluid delivery apparatus and dispensing the first batch of polishing fluid therefrom. In some embodiments, transferring a batch of polishing fluid between the first and second chambers of a multi-chamber fluid delivery apparatus includes opening a valve disposed therebetween to allow the polishing fluid to gravity flow from the first chamber to the second chamber. Once the batch is transferred, the valve is then closed to fluidly isolate the second chamber from the first chamber before the second chamber is pressurized to facilitate dispensing the first batch of polishing fluid onto the polishing pad.

At activity 406 the method 400 includes forming a second batch of polishing fluid concurrently with dispensing the first batch of polishing fluid onto the polishing pad. In embodiments where the fluid delivery apparatus comprises a multi-chamber fluid batch delivery apparatus, the second batch of polishing fluid is formed in the same chamber used to form the first batch of polishing fluid. In other embodiments, the second batch of polishing fluid is formed in a second fluid delivery apparatus which is disposed on or in a portion of the delivery arm positioned over the polishing pad.

In some embodiments the method 400 may comprise multiple cycles of sequentially mixing a small volume batch of polishing fluid and delivering the small volume batch of polishing fluid to the polishing pad within a single polishing cycle, i.e., from the beginning to the end of polishing a substrate on the polishing pad or a portion of the time there between. For example, if a typical polishing cycle were to take about one minute and require a polishing fluid flow rate of about 200 ml/min the total volume of polishing fluid used would be about 200 ml. For an apparatus having a 50 ml mixing volume, the method 400 may include forming and dispensing four 50 ml batches within the one minute polishing cycle and at least some of the 50 ml batches would be formed within about 20 seconds or less. If the apparatus were to have a 100 ml mixing volume, the method 400 may include forming and dispensing two 100 ml batches within the one minute polishing cycle. If one of the 100 ml batches were formed prior to the beginning of the polishing cycle than at least one of the 100 ml batches would be formed within about 1 minute or less, or even 30 second or less. Appropriate scaling may be used for polishing cycles of different duration, having different polishing fluid volume requirements, and/or fluid delivery apparatus having different mixing volumes. Thus, in some embodiments the method 400 may include sequentially forming and dispensing a plurality of small volume batches of polishing fluid within one substrate polishing cycle.

In some embodiments, two or more small volume batches of polishing fluid may be formed and dispensed within a substrate polishing cycle on a single polishing pad, such as three or more, or even four or more. In some embodiments, two or more small volume batches of polishing fluid may be formed and dispensed onto a single polishing pad within 4 minute or less, 3 minutes of less, 2 minutes or less, or within about 1 minute or less. In some embodiments, three or more small volume batches of polishing fluid may be formed and dispensed onto a single polishing pad within 4 minute or less, 3 minutes of less, 2 minutes or less, or within about 1 minute or less. In some embodiments, four or more small volume batches of polishing fluid may be formed and dispensed onto a single polishing pad within 4 minute or less, 3 minutes of less, or within about 2 minutes or less. In some embodiments, the composition of the polishing fluid formed in the small volume mixing apparatus is substantially the same from one small volume batch to the next during the duration of the substrate polishing cycle on a single polishing pad.

In some embodiments, the composition of the polishing fluid may change from one small volume batch to the next for one or more of the small volume batches provided to a single polishing pad during a substrate polishing cycle. Thus, in some embodiments, the method 400 comprises mixing and delivering at least two small volume batches of different composition during a substrate polishing cycle, such as at least three small volume batches of different composition, or at least four small volume batches of different composition during a substrate polishing cycle on a single polishing pad. In some embodiments, the method 400 comprises mixing and delivering at least three small volume batches of different composition during a substrate polishing cycle, such as at least three small volume batches of different composition, or at least four small volume batches of different composition during a substrate polishing cycle on a single polishing pad. In some embodiments, the method comprises mixing and delivering at least four small volume batches of different composition during a substrate polishing cycle, such as at least three small volume batches of different composition, or at least four small volume batches of different composition during a substrate polishing cycle on a single polishing pad.

Beneficially, the small batch mixing apparatus and methods described herein may be used with any CMP system where small batch mixing proximate to the point of delivery is desired. Further, the methods and apparatus set forth herein provide for rapid and sequential repetitions of small batch mixing and use within a single polishing cycle on a single polishing platen.

While the foregoing is directed to embodiments of the present disclosure, other and further embodiments of the disclosure may be devised without departing from the basic scope thereof, and the scope thereof is determined by the claims that follow.

The invention claimed is:

1. A polishing fluid delivery system, comprising:

a fluid batch delivery apparatus, comprising:

a vessel body having a first chamber and a second chamber disposed therein, wherein a volume of the second chamber is greater than a volume of the first chamber;

a plurality of at least two first delivery lines fluidly coupled to the first chamber;

a plurality of flow controllers in fluid communication with the at least two delivery lines, wherein a flow controller is configured to control a flow rate of material through each of the at least two delivery lines;

a dispense nozzle fluidly coupled to the second chamber;

a second delivery line fluidly coupled to the second chamber, wherein the second delivery line is open to an atmosphere;

a valve disposed between the first and second chambers; and a system controller comprises a program that causes material in the first chamber to transfer to the second chamber within a first time period, and causes the flow controllers to control the flow of material in each of the at least two delivery lines into the first chamber.

2. The polishing fluid delivery system of claim 1, further comprising a fluid delivery arm having a first end for coupling to an actuator and a second end distal from the first end, wherein the fluid batch delivery apparatus is sized and shaped to be disposed in or on the fluid delivery arm between the first and second ends.

3. The polishing fluid delivery system of claim 2, further comprising a plurality of third delivery lines which bypass the fluid batch delivery apparatus to deliver fluids, such as DI water, premixed polishing fluids, or cleaning fluids directly to a polishing pad.

4. The polishing fluid delivery system of claim 1, wherein the first chamber is disposed above the second chamber so that opening the valve causes fluids disposed in the first chamber to gravity flow into the second chamber.

5. The polishing fluid delivery system of claim 4, wherein a combined volume of the first and second chambers is less than 200 ml.

6. The polishing fluid delivery system of claim 4, wherein the system controller further comprises a non-transitory computer readable medium having instructions stored thereon for performing a method of polishing a substrate when executed by a processor, the method comprising:

flowing a plurality of polishing fluid components into the first chamber to form a first batch of polishing fluid, wherein a flow rate of the polishing fluid components is controlled by a signal provided from the system controller to a flow controller;

transferring the first batch of polishing fluid to the second chamber by opening the valve;

dispensing the first batch of polishing fluid onto a polishing pad by closing the valve and pressurizing the second chamber; and forming a second batch of polishing fluid in the first chamber concurrently with dispensing the first batch of polishing fluid from the second chamber.

7. The polishing fluid delivery system of claim 6, wherein a cycle time of forming the first batch of polishing fluid and dispensing the first batch of polishing fluid onto the polishing pad is about two minutes or less.

8. The polishing fluid delivery system of claim 1, wherein the plurality of at least two first delivery lines are fluidly coupled to a polishing fluids source, a polishing fluids components source, a deionized water source, and a pressurized gas source.

9. The polishing fluid delivery system of claim 1, wherein the system controller further comprises a non-transitory computer readable medium having instructions stored thereon for performing a method of polishing a substrate when executed by a processor, the method comprising:

flowing a plurality of polishing fluid components into the first chamber to form a first batch of polishing fluid, wherein a flow rate of the polishing fluid components is controlled by a flow controller;

transferring the first batch of polishing fluid to the second chamber;

dispensing the first batch of polishing fluid onto a polishing pad; and forming a second batch of polishing fluid in the first chamber concurrently with dispensing the first batch of polishing fluid from the second chamber.

10. The polishing fluid delivery system of claim 9, wherein a cycle time of forming the first batch of polishing fluid and dispensing the first batch of polishing fluid onto the polishing pad is about two minutes or less.

11. A polishing system, comprising:

a fluid delivery apparatus comprising:

a first chamber and a second chamber, wherein a volume of the second chamber is greater than a volume of the first chamber;

a plurality of at least two first delivery lines fluidly coupled to the first chamber;

a plurality of flow controllers in fluid communication with the at least two delivery lines, wherein a flow controller is configured to control a flow rate of material through each of the at least two delivery lines;

a dispense nozzle fluidly coupled to the second chamber;

a second delivery line fluidly coupled to the second chamber, wherein the second delivery line is open to an atmosphere; and a valve disposed between the first and second chambers;

a non-transitory computer readable medium having instructions stored thereon for performing a method of polishing a substrate when executed by a processor, the method comprising:

flowing a plurality of polishing fluid components into the first chamber of the fluid delivery apparatus at a flowrate controlled by a flow controller to form a first batch of polishing fluid, wherein the fluid delivery apparatus is disposed in or on a portion of a fluid delivery arm positioned over a polishing pad within a first time period;

transferring the first batch of polishing fluid from the first chamber to the second chamber within a second time period;

dispensing the first batch of polishing fluid from the second chamber onto the polishing pad within a third time period; and forming a second batch of polishing fluid in the first chamber concurrent with dispensing the first batch of polishing fluid within a fourth time period.

12. The polishing system of claim 11, wherein the second batch of polishing fluid is of a different composition than the first batch of polishing fluid.

13. The polishing system of claim 11, wherein the first batch of polishing fluid is transferred to the second chamber by opening the valve to allow the first batch of polishing fluid to gravity flow from the first chamber to the second chamber.

14. The polishing system of claim 13, wherein dispensing the first batch of polishing fluid onto the polishing pad comprises closing the valve and pressurizing the second chamber.

15. The polishing system of claim 11, further comprising a plurality of third delivery lines which bypass the fluid batch delivery apparatus to deliver fluids, such as DI water, premixed polishing fluids, or cleaning fluids directly to a polishing pad.

16. A polishing fluid delivery system comprising:

a fluid batch delivery apparatus, comprising:

a vessel body having a first chamber and a second chamber disposed therein, wherein a volume of the second chamber is greater than a volume of the first chamber;

a plurality of at least two first delivery lines fluidly coupled to the first chamber;

a plurality of flow controllers in fluid communication with the at least two delivery lines, wherein a flow controller is configured to control a flow rate of material through each of the at least two delivery lines;

a dispense nozzle fluidly coupled to the second chamber;

a second delivery line fluidly coupled to the second chamber;

a valve disposed between the first and second chambers;

a system controller comprises a program that causes material in the first chamber to transfer to the second chamber within a first time period, and causes the flow controllers to control the flow of material in each of the at least two delivery lines into the first chamber;

a fluid delivery arm having a first end for coupling to an actuator and a second end distal from the first end, wherein the fluid batch delivery apparatus is sized and shaped to be disposed in or on the fluid delivery arm between the first and second ends; and a plurality of third delivery lines which bypass the fluid batch delivery apparatus to deliver fluids, such as DI water, premixed polishing fluids, or cleaning fluids directly to a polishing pad.

17. The polishing fluid delivery system of claim 16, wherein the plurality of at least two first delivery lines are fluidly coupled to a polishing fluids source, a polishing fluids components source, a deionized water source, and a pressurized gas source.

18. The polishing fluid delivery system of claim 16, wherein the second delivery line is open to an atmosphere.

19. The polishing fluid delivery system of claim 16, wherein the first chamber is disposed above the second chamber so that opening the valve causes fluids disposed in the first chamber to gravity flow into the second chamber.

20. The polishing fluid delivery system of claim 16, wherein the system controller further comprises a non-transitory computer readable medium having instructions stored thereon for performing a method of polishing a substrate when executed by a processor, the method comprising:

flowing a plurality of polishing fluid components into the first chamber to form a first batch of polishing fluid, wherein a flow rate of the polishing fluid components is controlled by a flow controller;

transferring the first batch of polishing fluid to the second chamber;

dispensing the first batch of polishing fluid onto a polishing pad; and forming a second batch of polishing fluid in the first chamber concurrently with dispensing the first batch of polishing fluid from the second chamber.

* * * * *